United States Patent [19]

Jonsson

[11] 4,231,406

[45] Nov. 4, 1980

[54] DEVICE FOR TREATMENT OF THE SURFACE OF ROUND TIMBER

[76] Inventor: Karl-Erik A. Jonsson, Floraplan 14, S-802 28 Gävle, Sweden

[21] Appl. No.: 959,304

[22] Filed: Nov. 9, 1978

[30] Foreign Application Priority Data

Nov. 11, 1977 [SE] Sweden .....7712802

[51] Int. Cl.[3] ..... B27L 1/00

[52] U.S. Cl. ..... 144/208 E; 144/241; 407/48; 407/114

[58] Field of Search ..... 407/48, 49, 102, 103, 407/113, 114; 144/208 R, 208 E, 240, 241

[56] References Cited

U.S. PATENT DOCUMENTS

| | | | |
|---|---|---|---|
| 1,838,520 | 12/1931 | Archer | 407/113 |
| 2,880,771 | 4/1959 | Annis, Jr. | 144/208 E |
| 3,026,919 | 3/1962 | Lunn | 144/208 E |
| 3,045,322 | 7/1962 | Hertel | 407/113 |
| 3,189,067 | 6/1965 | Dillingham | 144/208 E |
| 3,629,919 | 9/1969 | Trevarrow, Jr. | 407/113 |

FOREIGN PATENT DOCUMENTS

| | | |
|---|---|---|
| 240591 | 6/1965 | Fed. Rep. of Germany . |
| 2405505 | 7/1976 | Fed. Rep. of Germany . |

*Primary Examiner*—W. Donald Bray

*Attorney, Agent, or Firm*—Birch, Stewart, Kolasch & Birch

[57] ABSTRACT

A cutting tool assembly for the surface treatment of round timber including an arm having at one end thereof a recess portion at least a portion of which is shaped substantially as a partial regular pyramid, a cutting tool shaped substantially as a regular pyramidal funnel adapted for engagement with and disposed in the recess and fastening means for removably securing the cutting tool in the recess.

23 Claims, 13 Drawing Figures

DEVICE FOR TREATMENT OF THE SURFACE OF ROUND TIMBER

BACKGROUND OF THE INVENTION

1. Field of the Invention

The present invention relates to machines for treatment of the surface of round timber, particularly such machines including at least one arm adapted to perform a rotational movement around the timber and to be swingable towards the timber during such movement in response to spring forces exerted on the arm. Specifically the invention relates to the combination of such an arm and a working tool removably attached to the free end of the arm.

2. Description of the Prior Art

U.S. Pat. No. 3,189,067 discloses a barking machine of the hollow rotor type having barking tools in the form of swingable arms. The barking part of the tool—the barking edge—is provided on a removable and easily replaceable element.

Through said U.S. Patent it is previously known also to locate not only the barking edge on such an element, but also the terminating and most wear exposed part of the edge of the swingable arm. This latter edge, the climbing edge, automatically makes the arm swing out to operative, barking position at contact with the leading end of timber fed through the rotor.

The mode of operation of the barking means of machines of the above kind is substantially as follows. The barking edge at the free end of the swingable arm is parallel to the longitudinal axis of the timber to be barked. This edge may be sharp but is generally more or less blunt. The barking edge is pressed against the surface of the timber under a spring force imparted by the swingable arm, which force is so chosen that the edge part of the arm penetrates the bark but not the wood surface. As the timber, or log, is fed in its longitudinal direction through the rotating rotor, this latter brings the swingable arm along, so that its edge moves in a helical path along the surface of the timber. Under the influence of the spring force directed towards the timber surface the edge is held in a continuous and sliding contact with the wood surface and loosens the bark encountered on the helical path from the wood, pushes the bark ahead in the rotational direction and throws it out of the rotor. This barking operation is made possible by the fact that bark and wood is kept together by a thin zone of minor strength, the so called cambium layer.

Loosening of the bark generally occurs by the force of the barking means in tangential direction resulting in shear stresses in the cambium layer exceeding the shear strength thereof. This kind of barking often is referred to as tangential shear barking and can also be described such that the barking tool is a scraper, the edge of which is kept in elastic contact with the comparatively hard wood surface and in tangential direction scrapes the soft bark off the round timber which is fed in axial direction through the barking machine.

Of importance for the barking result is the angle between tangential planes to the timber through the barking edge and the scraping or shearing plane of the tool; this angle is referred to as the "attacking angle".

The detachable and easily replaceable element shown in the drawings of U.S. Pat. No. 3,189,067 is constituted by a comparatively thick, rectangular plate. At the centre of one face the plate is provided with a cylindrical bolt. The plate rests againt a plane which is milled down in the swingable arm close to the free end thereof. In the said plane is a cylindrical recess wherein the cylindrical bolt fits. The plate is attached to the swingable arm by a screw passing through a bore in the arm. At tightening of the screw, however, the friction between the plate and the supporting plane-milled surface does not become so high that it cannot be ascertained that the plate does not rotate about the cylindrical bolt when the plate is exposed to forces in connection with barking and climbing. Hence, the plate is fixed by its edge facing the swinging axis of the arm being adapted to abut the shoulder extending across the arm, this shoulder resulting from the milling of the seat for the detachable element.

Detachable tips for barking tools corresponding to the description above have come to common use in barking machines of the hollow rotor type during the last ten year period. Although the maintenance of the active parts of the barking means has been facilitated hereby, the barking properties of such tools have been deteriorated in comparison with tools having a stationary tip. This is because the detachable tips hitherto used in this art have caused an increase of mass in the end portion of the arm in comparison with the case when stationary tools are employed. Thereby the inertia of mass of the swingable arm system has been remarkably increased. At unchanged revolution speed of the rotor and unchanged thrust force of the barking edge against the timber, the acceleration of the barking edge under the influence of the elastic press force becomes slower. Thereby the possibilities of the edge to follow the unevennesses of the wood surface diminish and this leads to a reduction of barking quality.

By lowering the speed of the rotor the barking quality can be improved and the increase of inertia of mass of the swingable arm system can be compensated for. This improvement, however, occurs at the cost of decreased capacity, since the possible feeding speed in the axial direction is proportional to the rotor speed. In order to achieve the self-evident characteristic of high capacity and good quality, a low inertia of mass is a significant and desirable factor.

Available detachable elements are usually produced by precision casting. The barking and climbing edges of such an element are coated with wear resistant alloys by welding or with hard metal plates by soldering. The mechanical strains on the plate, as well as thermal strains due to repeated hard metal coatings, cause a need to make the plate rigid, i.e. thick and heavy.

In order to provide a standardized swingable arm, provided with a likewise standardized plate seating, with a more forcefully scraping (aggressive) tool, such as the one described in U.S. Pat. No. 2,880,771, detachable tips are produced which are not plane-parallel but have increased thickness towards the barking edge. Such detachable tips having wedge shaped longitudinal sections have a greater mass than the normal plane-parallel detachable tips.

The wish to fasten the detachable tip with just one screw makes the precision achievable by casting insufficient. For replaceability and function, thus, not only the plate-seat with its cylindrical bore in the swingable arm but also the under-face and cylindrical bolt of the plate and its edge facing the shoulder of the seat must be worked with close tolerances. It is not possible to make such detachable elements turnable with two barking and two climbing edges; after turning the worn barking edge would not fit accurately enough against the shoulder of the plane-milled surface to prevent rotation and loosening of the element when it is used for its purpose. Detachable elements of this kind become so expensive in manufacture that non-recurring use hardly can be contemplated. Thus, the elements are detached from the swingable arms and are maintained in the same way as tools with stationary tips, i.e. by repeated hard metal coating and re-grinding of barking edge as well as climbing edge.

The object of the present invention is to provide turntable and light detachable tips for swingable arms in barking machines of the hollow rotor type and to shape the free end portion of the arms such that said portion together with a detachable tip form a single and easily detachable, but still secure joint. Detachable tips according to the invention are so cheap in manufacture that they can be discarded after use instead of being subjected to conventional normal hard metal coating and re-grinding operations. Detachable tips according to the invention are primarily intended for barking but may in combination therewith also be utilized for the automatic opening of the swingable arms. The invention is also applicable to cutting knives where the primary purpose is not to bark but to cut a helical notch through the bark down to the wood surface with assist of the hollow rotor machine. By means of the present invention the drawbacks of the known detachable tips set forth above are eliminated.

SUMMARY OF THE INVENTION

According to the present invention the detachable working means is provided with a substantially pyramidal portion which is adapted to co-operate with a recess in the free end of the swingable arm. The recess has a shape at least partly corresponding to the pyramidal portion of the working means so as to constitute an unrotatable joint between the working means and the arm when kept together by a force acting substantially in the direction of the pyramid axis.

The apex portion of the recess is removed by forming a through hole in the swingable arm essentially concentrically with the axis of the recess.

The detachable means is formed to a pyramid having confining surfaces corresponding to the pyramidal recess in the swingable arm. Along one or more of the sides of the pyramid base are provided the operative parts of the detachable means, i.e. its barking edge, climbing edge and cutting knife.

With a fastening means, e.g. screw and nut, which presses the detachable element against the pyramidal recess, or seat, in the swingable arm and retains it there, the detachable element is prevented by its engagement with the seat from being revolved by the barking (or climbing) forces in relation to the swingable arm. It may be advantageous to make the "funnel" angle of the recess somewhat smaller (e.g. 1°) than the "pyramid" angle of the corresponding detachable element. Thereby a secure and clearance-free bearing of the pyramidal guiding surfaces against each other is obtained when the detachable element is pressed against the seat by the fastening means.

The detachable means is preferably produced from metal plate by punching and pressing and then constitutes a pyramidal funnel. The rims of the funnel lying in the base plane of the pyramid constitute the edges of the detachable element for barking, climbing and cutting.

The material thickness, or wall thickness, of the funnel needs not be more than 2–2.5 mm. Consequently, it is easy to reach high degrees of hardness, e.g. 55 Rockwell C, by hardening and annealing comparatively simple materials, e.g. spring steel with 0,55% C and 1,75% Si. Detachable funnel shaped elements manufactured from such material and with such hardness have exhibited a remarkable resistance against wear caused by barking and climbing. The high hardness of the element has not led to brittle fractures as could be apprehended due to the considerable mechanical strain to which the element is exposed at use. Tests performed under working conditions have shown that the wear resistance of a 2 mm radius barking edge was such that about 100,000 land-born logs of 5 m length could be barked before the barking edge and the climbing edge had to be replaced.

In order to obtain equal endurance time with conventional tools it is necessary to employ expensive and complicated coating with hard metal alloys.

The apex portion of the pyramidal funnel is provided with a circular hole so that the detachable element resembles one of the conical washers of a cup or Belleville-spring. In comparison with the material thickness of the sheet metal used these pyramidal funnels become very rigid. Consequently, detachable elements manufactured in this way can be made very light. Likewise, the arrangement of the pyramidal recess in the free end of the swingable arm means removal of material from a part of the arm which is of particular importance in view of mass inertia. The combination of a pyramidal recess in the arm and a detachable funnel-shaped element for barking and climbing enables manufacture of swingable arms having insignificantly higher inertia than arms having a stationary tip and, consequently, significantly lower inertia than swingable arms equipped with conventional detachable tips.

When barking is performed, the detachable element and the pyramidal recess are oriented on the swingable arm such that at least one edge of the element becomes substantially parallel to the swinging axis of the arm and projects somewhat beyond the free end of the arm.

With the detachable element shaped like a pyramidal funnel, the plane thereof extending from the barking edge and facing the bark gets a considerably greater inclination (e.g. 20°–30°) to tangent planes of the wood surface through the barking edge than a plane through the base edges of the pyramid would have. The detachable element according to the present invention, thus, becomes more "aggressive" than a barking means where the barking edge is located in a plane-parallel detachable tip. This increased aggressiveness has been established not by weight increasing enlargements as is the case among the known detachable tips but, contrarily, by removal of material from the free end of the swingable arm. Further, there is no question of mechanical strain in the form of jerks or wood damage in the form of breaking out of splinters from the log-ends at climbing onto and descending from, respectively, the surface of the log by the arms. This is because the climbing edge and the backward edge parallel thereto of e.g. a funnel having square base plane has a substantially smaller inclination (e.g. 25° less) against the wood surface than has the funnel surface of the same detachable element adjacent to the barking edge.

It is also possible, and advantageous, to use the combination of swingable arm with pyramidal recess and a detachable pyramidal funnel for other purposes in a hollow rotor machine than barking. By providing the pyramidal recess on the side of the swingable arm facing the timber fed and by orienting the recess such that the base plane of the pyramidal funnel becomes substantially perpendicular to the axis of rotation of the rotor and further such that one of the edges of the funnel means (i.e. one of the sides of the pyramid base plane) constitute a continuation of and the terminating portion towards the free end of the climbing edge of the swingable arm, a basis is established for the creation of very suitable cutting tools having a number of, e.g. four, easily exchangeable cutting edges. These edges can be made in the simple manner of plane grinding the base edges of the funnel shaped means in the plane of the base surface. With appropriate inclination of the faces of the funnel (e.g. 30°) the edge angle desired is immediately obtained. Cutting tools of this kind are used in connection with certain tree species, such as fir and eucalyptus, where the high strength in the longitudinal direction of the timber causes trouble at barking.

There are also good possibilities, in correspondence with Canadian Pat. No. 698,050, to provide a pyramidal funnel element with barking edge as well as cutting edge. The cutting edge is then formed in an enlargement of the climbing edge. The enlargement is directed substantially perpendicularly to the base plane of the pyramid and is, thus, strongly inclined to the adjacent funnel surface. It should be pointed out, however, that a normal, pyramidal funnel element having a fairly sharp climbing edge, due to the considerable angle difference between climbing edge and barking plane, will function more or less in the same way as the combined cutting and barking means just mentioned. At movement of the barking edge across the wood surface the climbing edge runs ahead in the direction of movement and performs, in a cross direction of the tree, a cutting action on the bark about to be loosened by the barking edge. Hereby the bark gets better cut up and to some extent the formation of long bark scraps is prevented which may clog up the machine.

Only pyramidal recesses have been mentioned above where the base plane of the shaping pyramid is a square. In the inventive concept, however, lies also the utilization of pyramids having other base planes, e.g. triangular, rectangular or hexagonal. By the word "Pyramid" and forms derived therefrom, as used in the present specification and the appended claims to describe or denominate the detachable elements and the recesses corresponding thereto, should be understood objects and corresponding recesses the surfaces of which constitute portions of faces of pyramids or pyramid-like objects, said faces being plane or single-curved, but not bulged, i.e. double-curved. For each plane or single-curved surface applies in the connection considered that it shall have a generatrix which is a straight line parallel to the corresponding side of the polygon constituting the actual or imagined base surface of the pyramidal shape. It is understood that it is the substantially straight edges of the detachable element corresponding to these sides that, according to the present invention, are used for barking, cutting and climbing.

According to the above it is possible to use pyramids having curved or angled faces thereby to get an even more aggressive attacking angle of the shearing or scraping pyramid plane at the barking edge than is practical with a traditional pyramid having plane faces. A good combination can be to provide the part of the element resting in the recess with plane faces and to provide the part thereof extending from the recess to the barking edge with curved or angled section.

DESCRIPTION OF THE INVENTION

The inventive ideas given above will be more clearly understood from the following description, reference being made to the accompanying drawings, wherein FIG. 1 shows in perspective view a swingable arm and its shaft designated for use with a barking machine of the hollow rotor type, the arm being seen from the feeding side of the machine and being provided in its free end with a pyramidal recess according to the invention;

Figure 6:
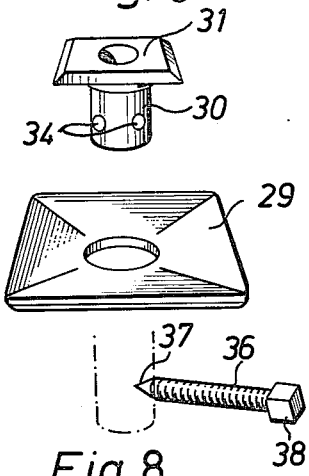
FIG. 6 shows a perspective exploded view of a detachable element for barking and climbing where the force keeping the element to the arm is provided by a screw forming substantially a right angle with the axis of symmetry of the recess.
Figure 7:
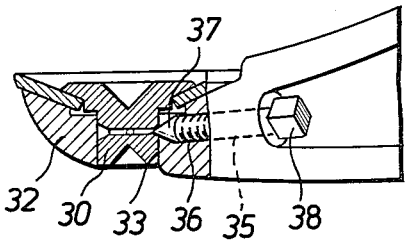
FIG. 7 shows a section through the outer end of a swingable arm having the elements of FIG. 6 mounted for barking and climbing, the section being taken substantially as in FIG. 3.
Figure 8:
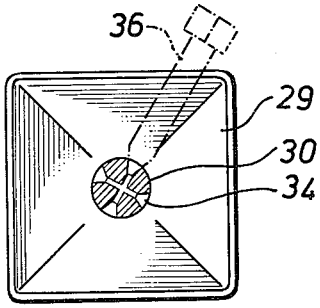
Figure 10:
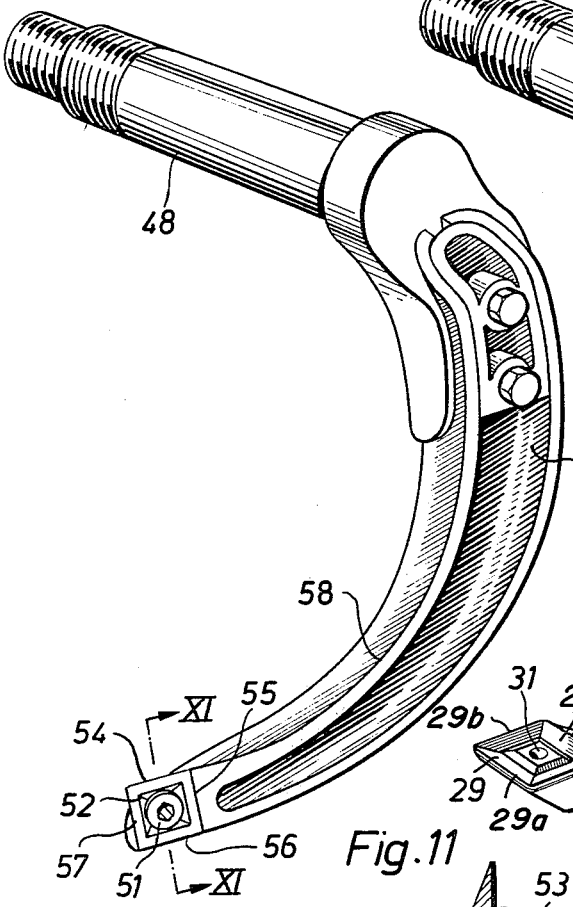
Figure 9:
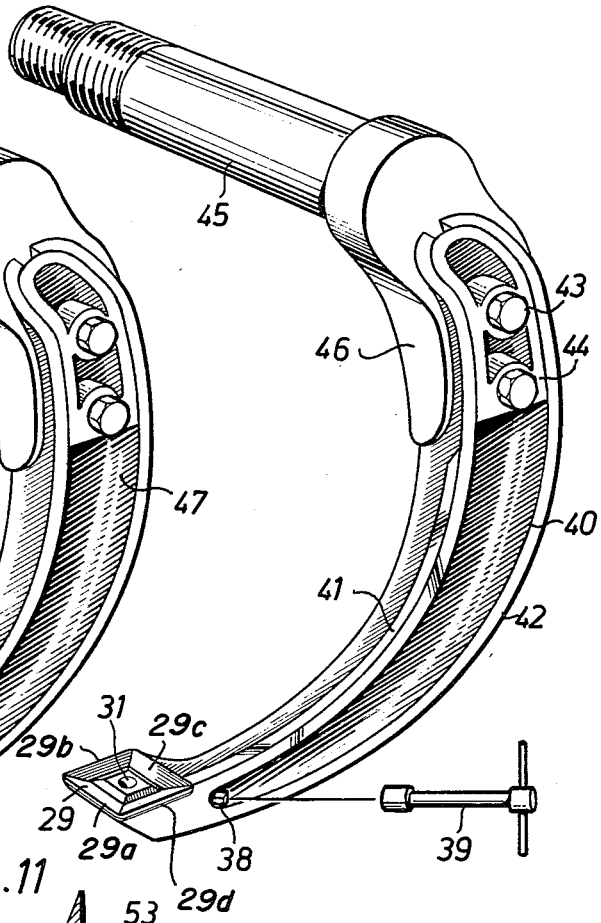
Figure 11:
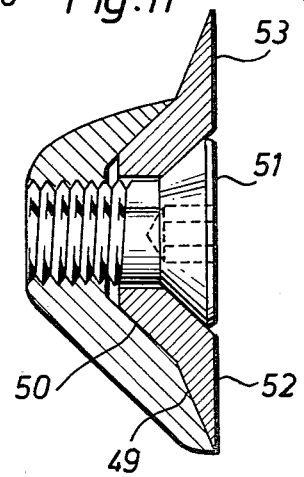
Figure 12:
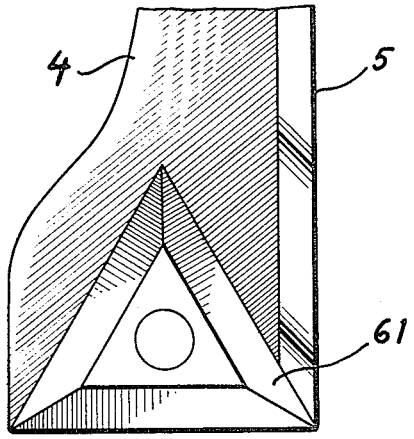
Figure 13:
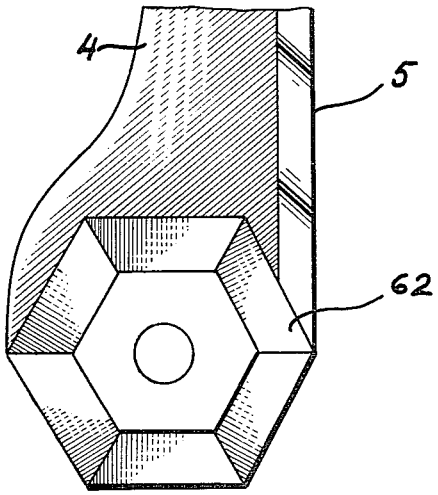

FIG. 8 shows the pyramidal element of FIGS. 6 and 7 (corresponding also to the elements of FIGS. 2 and 3) as seen towards the base plane of the pyramid. In the hole in the centre of the element is drawn a section through the cylindrical part of the fastening means of FIGS. 6 and 7, the section being taken through the axial plane wherein the conical portion of the fastening screw engages the cylindrical part;

FIG. 9 shows a perspective view of a groove- or channel-like swingable arm and its associated shaft according to U.S. Pat. No. 3,973,607, a detachable element being mounted in its free end according to FIGS. 6, 7 and 8;

FIG. 10 shows, in the same way as FIG. 9, a groove-shaped swingable arm. On the face thereof turned towards the timber fed the combination according to the invention of a pyramidal recess and a funnel shaped detachable element has been used to provide a cutting means which instead of barking cuts a helical notch in the bark;

FIG. 11 shows a section through the end portion of the arm according to FIG. 10, said section being taken on the line XI-XI of FIG. 10 through the axis of symmetry of the pyramidal recess and perpendicularly to the cutting edge of the detachable element;

FIG. 12 shows a view of the end portion of a swingable arm seen in a direction opposite its direction of movement across the surface of a log, the barking edge of the arm being constituted by one of the three edges of a pyramidal, easily detachable element, the base surface of which being an equilateral triangle;

FIG. 13 finally, shows, in the same way as FIG. 12, an easily detachable pyramidal element, the base surface of which being an equilateral hexagon.

Figure 1:
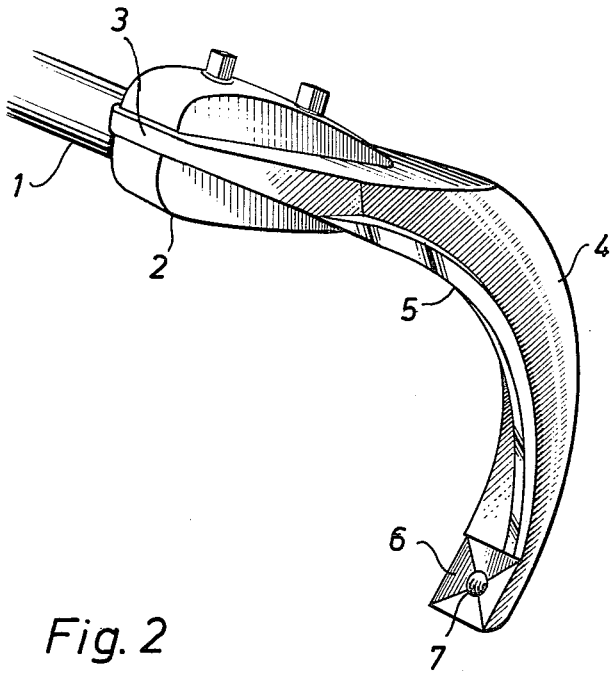

Referring first to FIG. 1, shaft 1 shown therein is part of a barking machine of the hollow rotor type, not shown. One end of the shaft is provided with a crosspiece 2, in a slot of which fits the fastening tongue 3 of a curved swingable arm 4 of a type common in the saw-mill industry. Along its concave face, and more precisely the part there of facing the logs fed, the arm is provided with a climbing edge 5. By engagement with the leading ends of the logs fed and by using the rotational movement of the rotor the edge 5 automatically swings the arm 4 out to operative position, viz. with its barking edge contacting the log surface. Close to its free end the arm 4 is provided, e.g. by milling, with a recess 6 the shape of which corresponds to a depression of partial regular pyramid having square or rectangular base plane. Two of the sides of this base plane are parallel to the swinging shaft 1. Concentrically to the axis of symmetry of the pyramidal recess a bore 7 is drilled through the arm 4.

Figure 2:
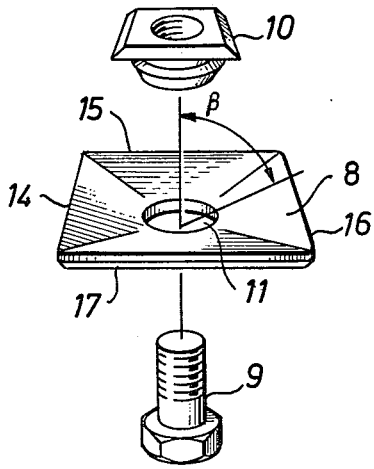
FIG. 2 shows a perspective exploded view of a detachable element according to the invention with fastening means in the form of a screw and a nut.
Figure 3:
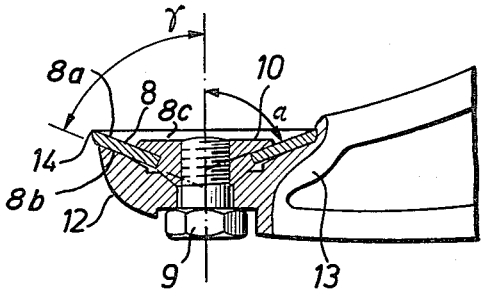
FIG. 3 shows a sectional view through the outer portion of the arm of FIG. 1 with the elements of FIG. 2 mounted for barking and climbing, the section being taken through the axis of symmetry of the pyramidal recess and perpendicularly to the barking edge of the detachable element.

In FIGS. 2 and 3, reference numeral 8 designates a detachable tool element, 9 a screw and 10 a square nut adapted for co-operation with screw 9 and element 8. Element 8 can be compared to a pyramidal funnel having a cavity 8*c*, the apex portion of which has been removed by the provision of a hole 11. The element 8 has a first substantially pyramidally shaped inner surface 8*a* and a second substantially pyramidally shaped outer surface 8*b*. The element is suitably produced from sheet metal by punching and pressing. From FIG. 3 is seen how the element 8 is mounted in the pyramidal seat 12 in the free end 13 of the arm 4 whereby inner surfaces 8*a* and outer surfaces 8*b* are substantially disposed in and at least partially substantially correspond to said recessed portion. The partial regular pyramid faces of element 8, nut 10 and seat 12 are manufactured with such accuracy that a clearance-free engagement therebetween is established at tightening of screw 9. It is advantageous to make nut 10, element 8 and seat 12 such that opposite pyramid faces, in the order given, define somewhat diminishing angles ($2\alpha > 2\beta > 2\gamma$; where $\alpha$, $\beta$ and $\gamma$ are half the apex angles of nut 10, unloaded element 8 and seat 12, respectively; FIGS. 2 and 3) with each other. Thereby it is ensured that the engagement between the surface 8*b* of element 8 and recess 6 and between nut 10 and surface 8*a* of element 8, respectively, becomes firm at the periphery of the seat and the nut, respectively.

As appears from FIG. 3 element 8 is somewhat larger than seat 12. Edge 14 of the funnel-shaped element 8 therefore projects beyond the arm to constitute a barking edge. Edge 14 may be sharp but is generally made blunt with a certain radius. In order to be resistant to wear either a suitable hardenable material is chosen for element 8, or edge 14 is coated by e.g. welding of hard metal alloys. By providing element 8 with a square base plane and by forming the remaining three edges 15, 16 and 17 in the same way as edge 14, four barking edges are provided on the detachable element 8. When one edge has been worn out element 8 is turned 90° relative to the seat 12. This is accomplished by loosening of screw 9 and nut 10, whereupon element 8 is rotated and thereafter fixed in the new position by tightening the screw and nut. The degree of wear of the barking edges does not affect the attachment since this is accomplished by the side faces of the pyramid and not by its base edges.

Instead of providing the detachable element with four barking edges it may be made with two barking and two lifting or climbing edges, or with one barking and three lifting edges. In the latter case it is presupposed that when the barking edge is worn such that it has to be replaced, at the same time the first lifting edge shall be so rounded by wear that it can serve as barking edge during the period of time it takes to wear down the next lifting edge, and so on. With an inclination of 20°–30° between the pyramid faces and its base plane it is easy to grind an edge having a suitable relief in the direction of the axis of symmetry so as to make the funnel edges constitute effective lifting means. Since it is the part of the climbing edge of the arm closest to the free end of the tool that is mostly exposed to wear, a consequence of the exchangeability is that the maintenance of the climbing edge can be radically diminished in comparison with the case when stationary tools are employed.

Figure 4:
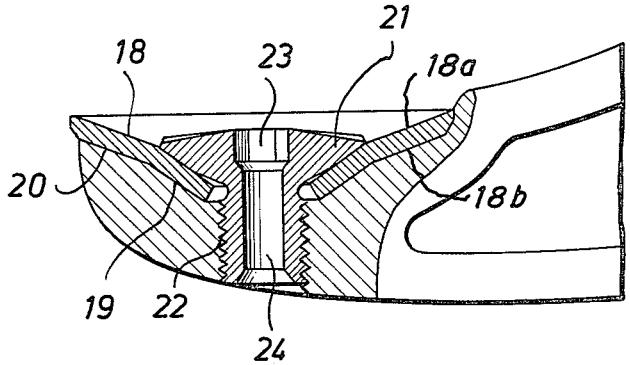
FIGS. 4 and 5 show on an enlarged scale views corresponding to that of FIG. 3 but concerning embodiments of pyramidal elements where the fastening means solely are constituted by screws.

The pyramidal funnel shaped detachable element 18 according to FIG. 4 has by pressing or machining been given an inner surface 18*a* and an outer surface 18*b* having a conical shape in the part 19 of the funnel adjacent the hole therethrough. The element is attached in the pyramidal recess 20 by a screw 21 having a conical head. The bore through the free end of the arm is provided with threads 22 engaging a screw 21. In the conical head of the screw is an aperture 23 adapted for a tool for rotating the screw. A bore 24 extends concentrically to the screw axis in order to decrease the mass of the end portion of the arm.

Figure 5:
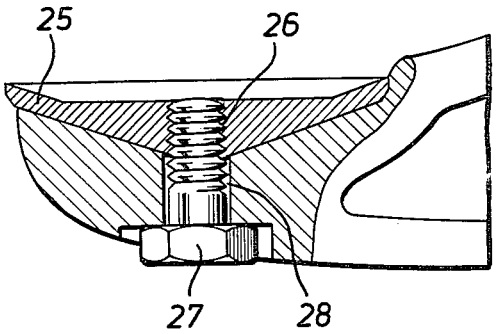

The detachable element may, e.g. when produced by precision casting, be provided with a filling of the lower part of the funnel, as is shown in FIG. 5. Thereby it is possible to provide the detachable element 25 with a threaded hole 26. Then the element can be kept in place by means of a conventional hexagonal head screw 27, which from the back side of the free end of the arm passes through the bore 28 into the threaded hole 26.

In FIGS. 6,7,8 and 9 the fastening means for the detachable element 29 is constituted by a cylindrical bolt or stud 30, which, e.g. by upsetting and machining, is provided with a square head 31 having pyramidal, lower abutment surfaces. Close to the free end 32 of the arm is a cylindrical bore 33, wherein the bolt 30 is slidable with little play. The cylindrical part of the bolt 30 is provided with four conical counterbores 34. In the outer part of the arm a bore 35 is drilled, which opens in the cylindrical bore 33 and is directed towards the axis thereof. Bore 35 is threaded for engagement by screw 36, which is terminated by a tapered portion 37 having the same apex angle as the counterbores 34. Bore 33, counterbores 34 and the pyramid faces of the square head 31 of the cylindrical bolt 30 are so arranged relative to each other that the bolt, guided by the cylindrical bore 33, by means of wedge action performed by the tapered portion 37 of screw 36 moves in such a direction as the screw 36 is rotated into thread 35, that the pyramidal element 29 is clamped against the seat at the free end 32 of the arm by the pyramidal surfaces of head 31 of bolt 30.

In FIG. 9 reference numeral 40 designates a groove-shaped swingable arm having substantially U-section with climbing edges 41 and 42 directed towards the timber fed. 43 and 44 designate screws attaching arm 40 to a likewise groove-shaped recess in a crosspiece 46 connected to shaft 45. The element 29 has a cutting edge 29*a*, and edges 29*c*, 29*d*, and 29*e*, respectively, whereby said edge 29*d* is aligned with and is an extension of climbing edge 41. From FIGS. 7 and 9 are clearly seen the good possibilities to locate the head 38 of screw 36 such that it is extensively protected against contact with wearing material while it still is easily accessible from the feeding side of the rotor. A key 39 is adapted for cooperation with screw head 38.

In FIGS. 10 and 11 reference numeral 47 designates a groove-shaped swingable arm attached to a shaft 48 in the same way as the arm according to FIG. 9. At the free end of the arm 47 and on the side thereof facing the timber fed there is provided a recess 49,50 corresponding, at least partly, to a truncated pyramid (49) having a square base plane 53. The pyramidal recess protion 49 transforms into a frusto conical recess portion 50. The generatrix of the conical recess portion 50 has a greater inclination to the base plane 53 than has the sides of the pyramidal recess portion 49. (Alternatively, portion 50 can have pyramidal shape). A countersink screw 51 threaded into the arm 47 fastens the detachable element 52 to the arm. Element 52 has the shape of a truncated quadrangular pyramid transforming into a truncated cone (which, alternatively, can be a truncated pyramid). The base surface 53 of the pyramid and its sides corresponding to recess portion 49 constitute four cutting edges 54,55,56 and 57 having edge angles suitable for cutting bark. The recess and the detachable element are so adapted to each other that one of the edges, 54, forms a direct continuation of climbing edge 58 towards the free end of arm 47. The pyramidal recess is made such that the material of the arm protects the edges 55,56 and partly edge 57 from being damaged by bark before they are turned into operative position after edge 54 has been worn inoperative. This possibility to provide a number of easily shiftable cutting edges on an element easily exchangeable per se is of great importance in the treatment of such timber where the barking operation must be preceded by or be combined with cutting of one or more helical notches in the bark.

In FIGS. 12 and 13, finally, detachable elements 61 and 62, respectively, are shown having triangular and hexagonal base surfaces, respectively. In correspondence to FIG. 1 the respective arms have reference numeral 4 and their climbing edges numeral 5.

I claim:

1. A cutting tool assembly comprising:
(a) an arm having at the free end thereof a recess portion having a substantially pyramidal shape;
(b) a cutting tool having a plurality of cutting edges and containing inner and outer major surfaces which substantially are disposed in and at least partially substantially correspond to said recessed portion; and
(c) fastening means for securing said cutting tool to said recessed portion of said arm.

2. A cutting tool assembly comprising:
(a) an arm having at the free end thereof a recess portion at least a portion of which is shaped substantially as a partial regular pyramid;
(b) a cutting tool having a plurality of cutting edges defining a regular polygon, said cutting tool having an outer major surface which substantially corresponds to said recess portion and an inner major surface defining a cavity, the walls of which at least in the cutting edge area thereof defining a partial regular pyramid, said outer and inner surfaces being substantially contained in said recess; and
(c) fastening means for securing said tool in said recess portion.

3. A cutting tool assembly comprising:
(a) an arm having at one end thereof a recess portion, at least a portion of which is shaped substantially as a partial regular pyramid;
(b) a cutting tool shaped substantially as a regular pyramidal funnel, said pyramidal funnel having a base and a plurality of pyramid faces, said tool having a plurality of cutting edges defining a regular polygon corresponding to the base of said pyramid, an outer major surface substantially corresponding to said pyramid faces and adapted for engagement with said recess and an inner major surface defining a cavity, the walls of which, at least in the cutting edge area thereof, corresponding to said pyramid faces; and
(c) fastening means for securing said tool in said recess.

4. A device according to claim 1, 2 or 3 characterized in that said tool is provided with a central hole and that said arm is provided with a bore co-axial with said hole, said hole and said bore being adapted to receive said fastening means.

5. A device according to claim 4, characterized in that the fastening means comprises a screw and a nut.

6. A cutting tool assembly according to claim 5, wherein said nut has a surface substantially corresponding to and adapted for engagement with said inner surface of said tool.

7. A device according to claim 4, characterized in that the fastening means comprises a screw and corresponding threads in said bore.

8. A cutting tool assembly according to claim 7, wherein said screw includes a head having a shape substantially corresponding to and adapted for engagement with said inner surface of said tool.

9. A device according to claim 4, characterized in that the fastening means comprises a screw and corresponding threads in said central hole.

10. A device according to claim 4, characterized in that the fastening means comprises a cylindrical bolt having a head adapted to abut said tool, said bolt having at least one radially extending counterbore, and a screw threaded into said arm said screw having a tapered end, said counterbore and said screw being arranged relative to each other whereby tightening of said screw causes force by wedge action between said counterbore (34) and said tapered screw end (37) thereby securely fastening said tool in said recess.

11. A cutting tool assembly according to claim 10, wherein said bolt head has a shape substantially corresponding to and adapted for engagement with said inner surface of said tool.

12. A device according to claims 1, 2, or 3, characterized in that said tool is made of sheet metal.

13. A device according to claim 12, characterized in that the pyramidal portion of said tool has an apex angle differing from the corresponding angle of the corresponding portion of the recess such that the fastening means causes elastic deformation of said tool in order to further strengthen the unrotatable joint.

14. A device according to claim 12, characterized in that the tool is made by precision casting and/or machining.

15. A cutting tool assembly according to claim 12, wherein said sheet metal has a thickness of from 2–2.5 mm.

16. A cutting tool assembly according to claim 12, wherein said sheet metal is plastic formed by punching or pressing.

17. A cutting tool assembly according to claim 1, 2, or 3, wherein said arm contains a bore located along the axis of said regular pyramid.

18. A cutting tool assembly according to claim 17, wherein said fastening means extends into said bore for releasably securing said tool in said recess.

19. A cutting tool assembly according to claim 18, wherein said fastening means extends substantially along the axis of said regular pyramid.

20. A cutting tool assembly according to claim 1, 2, or 3, wherein said arm includes a climbing edge extending along said arm, said climbing edge being an extension of at least one of said cutting edges.

21. A cutting tool assembly according to claim 1, 2, or 3, wherein said fastening means presses on said inner major surface of said tool to secure said tool in said recess.

22. A cutting tool for the surface treatment of round timber, said tool being shaped at least partially substantially as a regular pyramidal funnel, said pyramidal funnel having a base and a plurality of pyramidal faces comprising:

(a) a plurality of cutting edges shaped as a regular polygon corresponding to the base of said regular pyramid;

(b) an outer major surface substantially corresponding to said pyramid faces; and (c) an inner major surface defining a cavity, the walls of which at least in the cutting edge area thereof corresponding to said pyramid faces.

23. A cutting tool assembly comprises a detachable tool and an arm adapted to carry said tool, said tool having a plurality of cutting edges defining a regular polygon and an outer shape having at least a portion thereof substantially defining a regular pyramid, and said arm having a recess at least substantially shaped as a regular pyramid base adapted to receive therein the pyramidal portion of said tool, said arm containing a bore disposed along the axis of said regular pyramid, said tool having a recess the walls of which at least in the cutting edge area thereof defining a partial regular pyramid, said outer pyramidal shape and said tool recess having a common pyramid axis, fastening means extending into said bore in said arm, said fastening means being releasably secured to said arm such that said tool is rotatable about said axis in a released condition of said fastening means.

* * * * *